US005634247A

United States Patent [19]

Bowling

[11] Patent Number: 5,634,247

[45] Date of Patent: Jun. 3, 1997

[54] PUFFING ASSEMBLY FOR BURIAL CASKET CAP DISH ASSEMBLY

[75] Inventor: Donald W. Bowling, Osgood, Ind.

[73] Assignee: Batesville Casket Company, Inc., Batesville, Ind.

[21] Appl. No.: 553,878

[22] Filed: Nov. 6, 1995

[51] Int. Cl.[6] ..... A61G 17/00

[52] U.S. Cl. ..... 27/19; 27/4

[58] Field of Search ..... 27/14, 16, 19, 27/2, 4, 35; 229/198.2, 190, 198

[56] References Cited

U.S. PATENT DOCUMENTS

| | | | |
|---|---|---|---|
| 2,338,035 | 12/1943 | Gerold . | |
| 2,664,615 | 1/1954 | Hillenbrand et al. . | |
| 2,964,824 | 12/1960 | Hillenbrand . | |
| 3,157,936 | 11/1964 | Hillenbrand . | |
| 3,316,608 | 5/1967 | Ross . | |
| 4,639,985 | 2/1987 | Craft | 27/19 |
| 5,495,648 | 3/1996 | Rojdev et al. | 27/19 |

*Primary Examiner*—Kien T. Nguyen
*Attorney, Agent, or Firm*—Wood, Herron & Evans, L.L.P.

[57] ABSTRACT

A puffing assembly forming a part of a dish assembly for installation into the underside of a burial casket cap comprises at least two puffing members having adjacent ends adapted to form a miter corner thereat when secured together. One of the puffing members has an arcuate score line traversing a respective end thereof to define a first elongated portion and a second tab portion of the one puffing member. The puffing member adjacent ends are secured together with fasteners outboard of the arcuate score line. When the secured together puffing members are pivoted away from one another by about 90° a miter corner of about 45° is formed and the fasteners are not visible through the miter corner. The end of the other puffing member folds the tab portion of the one puffing member to form an angle of about 90° with respect to the elongated portion of the one puffing member. This positions the fasteners at an angle of about 45° relative to the miter corner thus preventing the fasteners from being visible through the miter corner.

12 Claims, 3 Drawing Sheets

PUFFING ASSEMBLY FOR BURIAL CASKET CAP DISH ASSEMBLY

FIELD OF THE INVENTION

This invention relates generally to burial caskets, and more particularly to puffing assemblies for dish assemblies for burial casket caps.

BACKGROUND OF THE INVENTION

Burial caskets traditionally comprise a shell to which is pivoted a cap or lid. During viewing of the deceased in the casket, the cap is of course pivoted to its open position to permit relatives, loved ones, acquaintances and the like to view the deceased. During this time the underside of the casket cap is visible. It is thus desirable to trim the underside of the cap with decorative trim. This has been traditionally accomplished with the installation of a dish assembly into the underside of the cap.

The traditional dish assembly has taken the form of a rectangular cap panel having two long sides and two short sides, with a puffing board or panel or member being attached to each of the four sides with staples. The puffing boards, typically fabricated of a relatively stiff yet flexible substrate such as chipboard, are covered with decorative fabric. The cap panel is positioned in the casket cap atop a standoff, itself positioned in the cap, or atop a ridge or groove forming a part of the cap. The free edges of the puffing members are retained in a peripheral groove in the casket cap near the peripheral edge of the cap. The puffing members are so sized as to require them to assume a convex quarter-round shape for their free edges to be retained in the peripheral groove. A rectangular cap panel insert, including decorative embroidery or the like, may be removably installed between the four puffing members and in juxtaposition relative to the cap panel. Various means may be provided to secure the cap panel insert into the dish assembly.

Miter corners are formed at adjacent ends of the puffing members. The miter corners may either be formed by simply overlapping the adjacent puffing member ends or by stapling the adjacent ends together.

In corners formed by overlapping, the top, or overlapped, puffing member, the end edge of which is arcuately shaped such that when flexed into a convex quarter-round shape the edge forms an angle of 45 degrees with respect to the cap panel corner, relies on its corresponding underlying puffing member for support. The underlying puffing member has no independent means of support, but rather, relies solely on the compression of the puffing member as it is being maintained in its respective grooves to maintain its convex shape. The underlying puffing member extends a short distance beyond the line where it is contacted by the overlying puffing member arcuate end edge, i.e. by some amount beyond a curve generated by reflecting the arcuate end edge of the overlying puffing member about a 45 degree line extending from the cap panel corner and projecting it onto the underlying puffing member when the dish blank is in the flat or unconstructed state, sufficient to provide for overlapping, thereby providing a neat, aesthetically pleasing miter corner with no gap thereat.

Thus, while the overlapped miter corner presents an aesthetically pleasing gap-free miter during normal use, should the underlying puffing member be inadvertently pressed or crushed during handling, the overlap miter corner opens up creating an unsightly gap at that corner. One example of overlapped miter corners is disclosed in U.S. Pat. No. 3,316,608.

In miter corners where the adjacent puffing ends are stapled together, both of the adjacent puffing ends include a series of tabs which are formed along an arc. The tabs are scored at their bases to allow the tabs to bend relative to the balance of the puffing member. Staples secure corresponding ones of the tabs of adjacent abutted puffing member ends together. Cut outs between adjacent tabs allow the ends of the puffing members to form into a convex shape at the miter corners. The arc of the tabs of each puffing end is formed such that when flexed into a convex quarter-round shape the adjacent abutted puffing ends form a miter corner of 45 degrees with respect to the cap panel corner.

While this type of puffing miter corner provides a level of strength not obtainable by overlapped miter corners, the disadvantage is that some gaps often appear in the miter corner due to the nature of the abutted and stapled construction; thus the staples securing the adjacent puffing member ends together are often visible through the miter corner thus presenting an unsightly appearance. One example of stapled miter corners is disclosed in U.S. Pat. No. 2,964,824.

It is therefore one objective of the present invention to provide a stronger puffing assembly corner construction than is achievable with the use of overlapped miter corners.

It is another objective of the present invention to provide a puffing assembly corner construction where the staples securing the adjacent ends of the puffing members together are not visible through the miter corner.

It is yet another objective of the present invention to provide an aesthetically pleasing puffing assembly miter corner construction.

It is still another objective of the present invention to provide a strong puffing assembly miter corner construction.

It is a further objective of the present invention to provide a puffing assembly miter corner construction which combines the superior aesthetics of the overlapped miter corner with the superior strength of the stapled miter corner.

SUMMARY OF THE INVENTION

In accordance with the stated objectives the present invention provides a puffing assembly forming a part of a dish assembly for installation into the underside of a burial casket cap. The puffing assembly comprises at least two puffing members having adjacent ends adapted to form a miter corner thereat when secured together. One of the puffing members has an arcuate score line traversing a respective end thereof to define a first elongated portion and a second tab portion of the one puffing member. The puffing member adjacent ends are secured together with fasteners outboard of the arcuate score line. When the secured together puffing members are pivoted away from one another by about 90° a miter corner of about 45° is formed and the fasteners are not visible through the miter corner.

The end of the other puffing member folds the tab portion of the one puffing member to form an angle of about 90° with respect to the elongated portion of the one puffing member. This positions the fasteners at an angle of about 45° relative to the miter corner thus preventing the fasteners from being visible through the miter corner.

The fasteners are preferably staples.

A dish assembly comprising a cap panel and the above puffing assembly mounted peripherally around the cap panel, and a casket comprising a shell, a cap pivoted to the shell and the above dish assembly mounted within the underside of the cap, are also provided.

One advantage of the present invention is that a stronger puffing assembly corner construction than is achievable with the use of overlapped miter corners is provided.

Another advantage of the present invention is that a puffing assembly corner construction is provided where the staples securing the adjacent ends of the puffing members together are not visible through the miter corner.

Yet another advantage of the present invention is that an aesthetically pleasing puffing assembly miter corner construction is provided.

Still another advantage of the present invention is that a strong puffing assembly miter corner construction is provided.

A further advantage of the present invention is that a puffing assembly miter corner construction is provided which combines the superior aesthetics of the overlapped miter corner with the superior strength of the stapled miter corner.

These and other objects and advantages of the present invention will become more readily apparent during the following detailed description taken in conjunction with the drawings herein, in which:

DETAILED DESCRIPTION OF THE INVENTION

Figure 1:
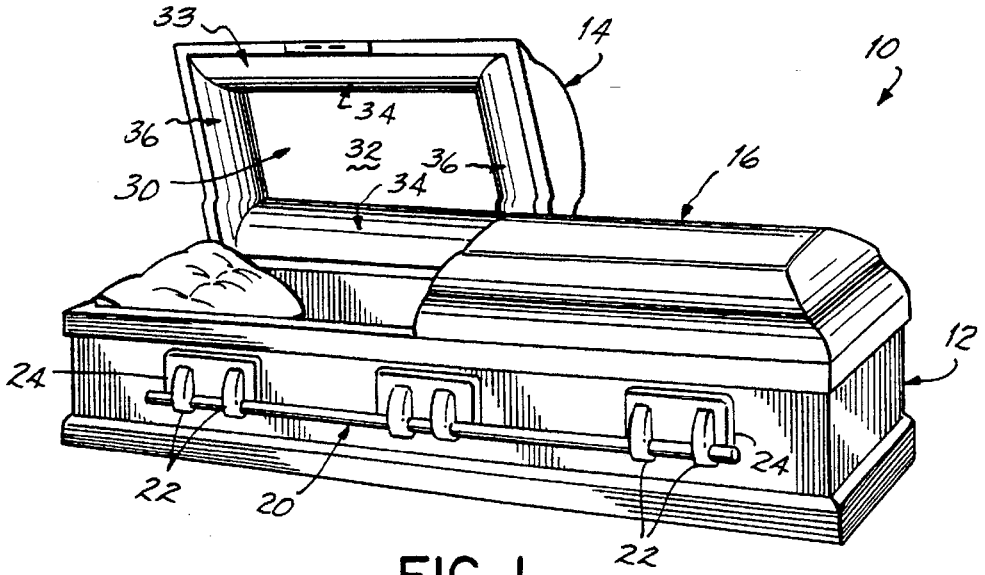
FIG. 1 is a perspective view of a casket incorporating a dish assembly with the puffing assembly of the present invention.

Referring first to FIG. 1, there is illustrated a casket 10 incorporating the principles of the present invention. The casket 10 includes a shell to which is pivoted a head end cap 14 and a foot end cap 16. A handle 20 is attached to either side of the shell 12 through arms 22 attached to ears or escutcheons 24 which are in turn attached to the shell 12 with fasteners (not shown).

The casket 10 includes a decorative dish assembly 30 which comprises a rectangular cap panel 32, and a puffing assembly 33 attached to the cap panel 32 around its periphery and comprising a first set of opposed puffing panels in the form of a pair of side puffing panels 34,34 and a second set of opposed puffing panels in the form of a pair of end puffing panels 36,36. A decorative cap panel insert (not shown) may be removably positioned centrally of the puffing panels 34,36 and in juxtaposition with respect to the cap panel 32 if desired.

Figure 2:
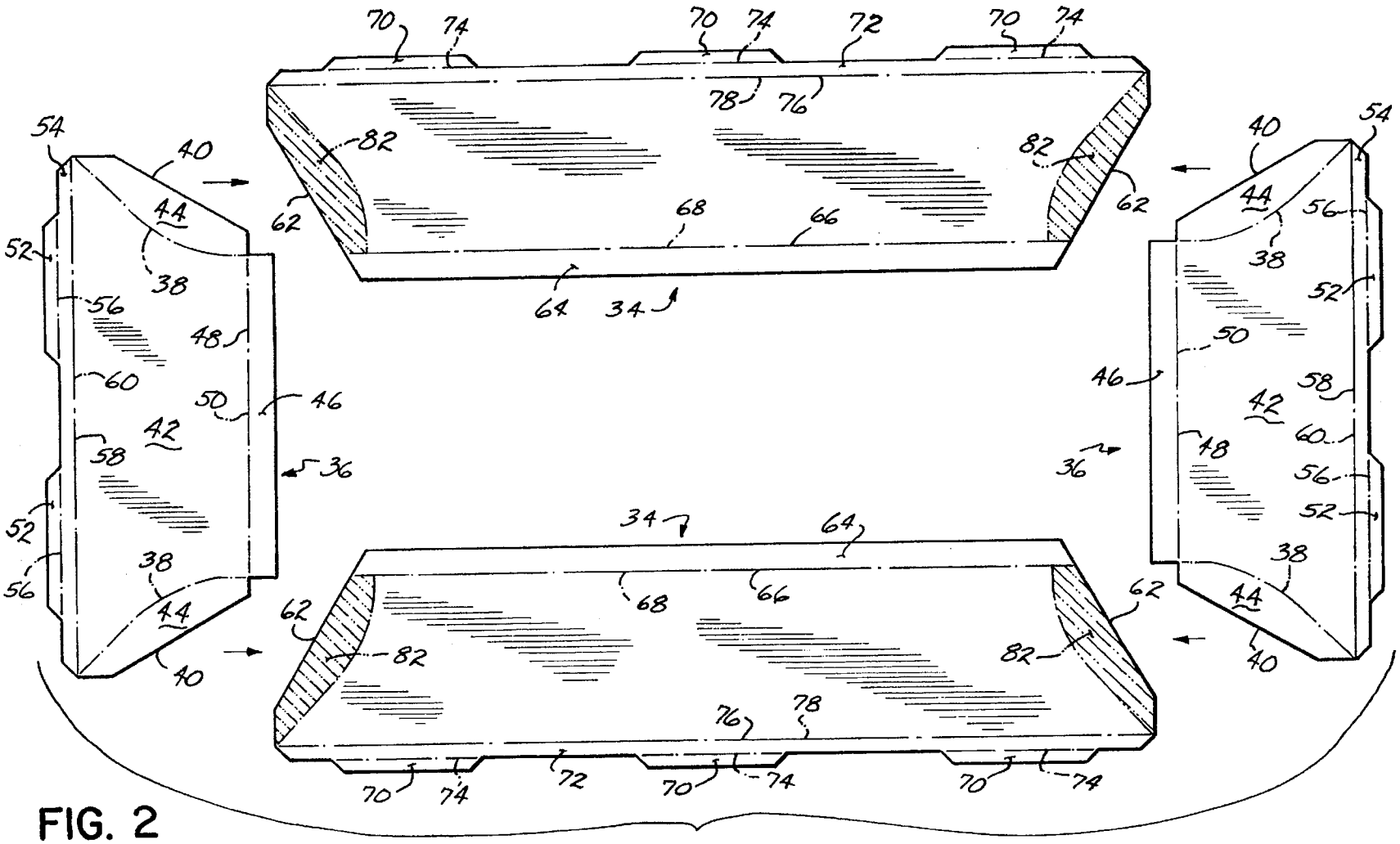
FIG. 2 is a top plan view of an unassembled puffing assembly of the present invention.
Figure 6:
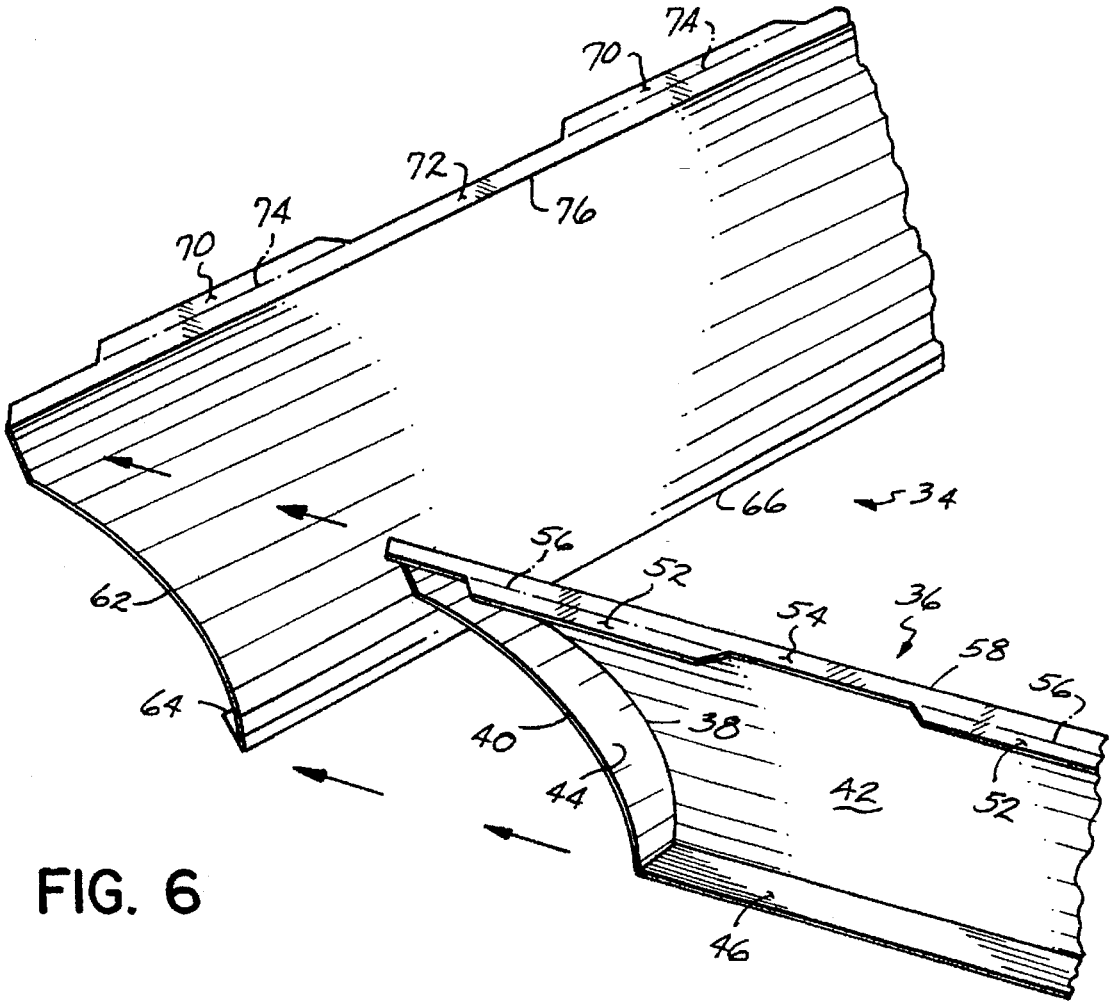
FIG. 6 is a view taken along line 6—6 of FIG. 3 but illustrated in exploded form.

Referring now to FIG. 2, the puffing assembly 33 is illustrated in unassembled form. As described above, the puffing assembly 33 includes a pair of side puffing panels 34,34 and a pair of end puffing panels 36,36 which are attached in a manner to be described. Each end puffing panel 36 has an arcuate score line 38 traversing a respective end 40 thereby defining a first elongated portion 42 of the end puffing member 36 and a second tab portion 44 at each end 40 of the end puffing member 36. End puffing member 36 also includes a long tab 46 joined to short side 48 of the elongated portion 42 of the puffing member 36 via a score line 50 for attachment to the cap panel 32 (not shown in FIG. 2). End puffing member 36 further includes a pair of short tabs 52 each of which is joined to a long tab 54 via score lines 56. Long tab 54 is itself joined to long side 58 of the elongated portion 42 of the puffing member 36 via a score line 60.

Each side puffing panel 34 has a pair of ends 62. A long tab 64 is joined to short side 66 of the puffing member 34 via a score line 68 for attachment to the cap panel 32. Side puffing member 34 further includes a three short tabs 70 each of which is joined to a long tab 72 via score lines 74. Long tab 72 is itself joined to long side 76 of the puffing member 34 via a score line 78. Tabs 52,54 and 70,72 are for securing the dish assembly 30 into the underside of the cap 12 and maintaining the puffing members 34 in a convex, quarter-round shape as is conventional.

More particularly, staples 80 or other suitable means of connection such as sewing, gluing, snaps, hook and loop type fasteners or the like, are affixed to the ends 40 of the end puffing panels 36 outboard of the score lines 38. Cross-hatched areas 82 at the ends 62 of the side puffing members 34 illustrate the general area where the fasteners (staples 80 as illustrated in FIGS. 3 and 4) are attached to those side puffing panel ends 62 when the fasteners are so located outboard of score lines 38.

Figure 3:
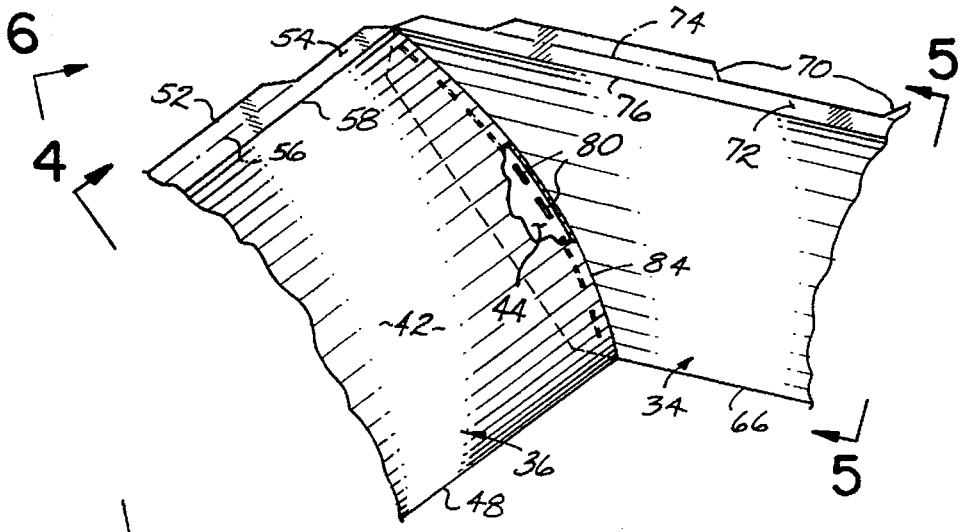
FIG. 3 is a view of the upper right hand corner (when viewed as installed into the casket cap) of an assembled puffing assembly of the present invention bug viewed from underneath.
Figure 4:
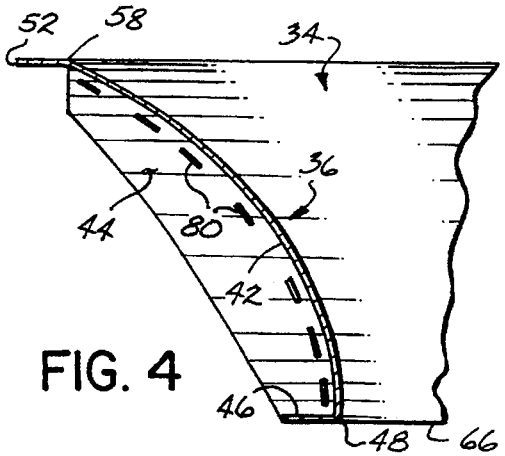
FIG. 4 is a view taken along line 4—4 of FIG. 3.
Figure 5:
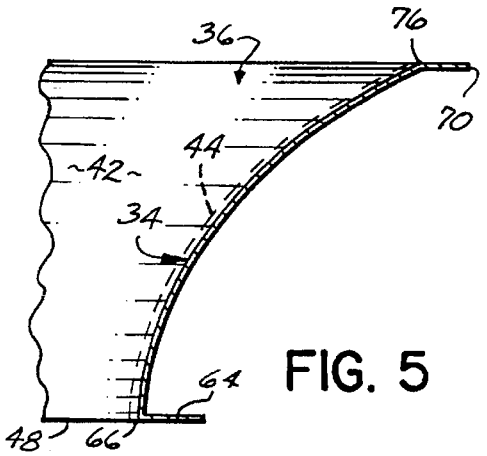
FIG. 5 is a view taken along line 5—5 of FIG. 3.

Referring now particularly to FIGS. 3–5, it will be seen that due to the ends of the end puffing panels being scored and due to the ends of the side puffing panels not being scored, when adjacent ends of adjacent side and end panels are placed atop one another in confronting relation, are stapled, and then the side and end panels are unfolded or pivoted away from each other to about 90° a 45° miter corner is formed. The staples are not visible through the miter corner. This is because the end 62 of the side puffing panel 34 folds the tab portion 44 of the end 40 of the end puffing member 36 to form an angle of about 90° with respect to the elongated portion 42 of the end puffing member 36 as is best seen in FIGS. 4 and 5, while the side puffing members 34 remain straight. This positions the fasteners 80 at an angle of about 45° relative to the miter corner (which itself is at about 45°) thus obscuring the fasteners 80 from view when looking at the 45° miter corner straight on. In addition, due to the stapled and folded nature of the corner construction, a very strong miter corner 84 is formed and one which will not open up and exhibit unsightly gaps.

Those skilled in the art will readily recognize numerous adaptations and modifications which can be made to the present invention which will result in an improved puffing assembly for a burial casket cap dish assembly, yet all of which will fall within the spirit and scope of the present invention as defined in the following claims. Accordingly, the invention is to be limited only by the scope of the following claims and their equivalents.

What is claimed is:

1. A puffing assembly forming a part of a dish assembly for installation into the underside of a burial casket cap, said puffing assembly comprising:

at least two puffing members having adjacent ends adapted to form a miter corner thereat when secured together;

only one of said puffing members having an arcuate score line traversing a respective end thereby defining a first elongated portion of the one puffing member and a second tab portion of the one puffing member;

said puffing member adjacent ends being secured together with fasteners outboard of said arcuate score line;

whereby when said secured together puffing members are pivoted away from one another by about 90° a miter corner of about 45° is formed and said fasteners are not visible through said miter corner.

2. A puffing assembly forming a part of a dish assembly for installation into the underside of a burial casket cap, said puffing assembly comprising:

at least two puffing members having adjacent ends adapted to form a miter corner thereat when secured together;

one of said puffing members having an arcuate score line traversing a respective end thereby defining a first elongated portion of the one puffing member and a second tab portion of the one puffing member;

said puffing member adjacent ends being secured together with fasteners outboard of said arcuate score line;

whereby when said secured together puffing members are pivoted away from one another by about 90° a miter corner of about 45° is formed and said fasteners are not visible through said miter corner;

wherein said end of the other puffing member folds said tab portion of the one puffing member to form an angle of about 90° with respect to said elongated portion of the one puffing member when said puffing members are pivoted away from one another by about 90°.

3. The puffing assembly of claim 2 wherein said fasteners are positioned at an angle of about 45° relative to said miter corner when said puffing members are pivoted away from one another by about 90°.

4. The puffing assembly of claim 3 wherein said fasteners are staples.

5. A dish assembly for installation into the underside of a burial casket cap, said dish assembly comprising a cap panel and a puffing assembly mounted peripherally around said cap panel, said puffing assembly comprising:

at least two puffing members having adjacent ends adapted to form a miter corner thereat when secured together;

only one of said puffing members having an arcuate score line traversing a respective end thereby defining a first elongated portion of the one puffing member and a second tab portion of the one puffing member;

said puffing member adjacent ends being secured together with fasteners outboard of said arcuate score line;

whereby when said secured together puffing members are pivoted away from one another by about 90° a miter corner of about 45° is formed and said fasteners are not visible through said miter corner.

6. A dish assembly for installation into the underside of a burial casket cap, said dish assembly comprising a cap panel and a puffing assembly mounted peripherally around said cap panel, said puffing assembly comprising:

at least two puffing members having adjacent ends adapted to form a miter corner thereat when secured together;

one of said puffing members having an arcuate score line traversing a respective end thereby defining a first elongated portion of the one puffing member and a second tab portion of the one puffing member;

said puffing member adjacent ends being secured together with fasteners outboard of said arcuate score line;

whereby when said secured together puffing members are pivoted away from one another by about 90° a miter corner of about 45° is formed and said fasteners are not visible through said miter corner;

wherein said end of the other puffing member folds said tab portion of the one puffing member to form an angle of about 90° with respect to said elongated portion of the one puffing member when said puffing members are pivoted away from one another by about 90°.

7. The dish assembly of claim 6 wherein said fasteners are positioned at an angle of about 45° relative to said miter corner when said puffing members are pivoted away from one another by about 90°.

8. The dish assembly of claim 7 wherein said fasteners are staples.

9. A burial casket comprising a shell, a cap pivoted to said shell and a dish assembly mounted within the underside of said cap, said dish assembly comprising a cap panel and a puffing assembly mounted peripherally around said cap panel, said puffing assembly comprising:

at least two puffing members having adjacent ends adapted to form a miter corner thereat when secured together;

only one of said puffing members having an arcuate score line traversing a respective end thereby defining a first elongated portion of the one puffing member and a second tab portion of the one puffing member;

said puffing member adjacent ends being secured together with fasteners outboard of said arcuate score line;

whereby when said secured together puffing members are pivoted away from one another by about 90° a miter corner of about 45° is formed and said fasteners are not visible through said miter corner.

10. A burial casket comprising a shell, a cap pivoted to said shell and a dish assembly mounted within the underside of said cap, said dish assembly comprising a cap panel and a puffing assembly mounted peripherally around said cap panel, said puffing assembly comprising:

at least two puffing members having adjacent ends adapted to form a miter corner thereat when secured together;

one of said puffing members having an arcuate score line traversing a respective end thereby defining a first elongated portion of the one puffing member and a second tab portion of the one puffing member;

said puffing member adjacent ends being secured together with fasteners outboard of said arcuate score line;

whereby when said secured together puffing members are pivoted away from one another by about 90° a miter corner of about 45° is formed and said fasteners are not visible through said miter corner;

wherein said end of the other puffing member folds said tab portion of the one puffing member to form an angle of about 90° with respect to said elongated portion of the one puffing member when said puffing members are pivoted away from one another by about 90°.

11. The casket of claim 10 wherein said fasteners are positioned at an angle of about 45° relative to said miter corner when said puffing members are pivoted away from one another by about 90°.

12. The casket of claim 11 wherein said fasteners are staples.

* * * * *